United States Patent [19]

Jolivet et al.

[11] Patent Number: 5,042,563

[45] Date of Patent: Aug. 27, 1991

[54] PROCESS AND INSTALLATION FOR CASTING THIN METAL PRODUCTS, WITH REDUCTION OF THICKNESS BELOW THE INGOT MOLD

[75] Inventors: Jean-Marc Jolivet, Guenange; Bernard Robert, Metz, both of France

[73] Assignee: Techmetal Promotion, Metz, France

[21] Appl. No.: 503,863

[22] Filed: Apr. 3, 1990

[30] Foreign Application Priority Data

Apr. 6, 1989 [FR] France ..... 89 04857

[51] Int. Cl.[5] ..... B22D 11/00

[52] U.S. Cl. ..... 164/476; 164/417; 148/2

[58] Field of Search ..... 164/476, 417, 418, 459, 164/460, 263; 148/2

[56] References Cited

FOREIGN PATENT DOCUMENTS 2733276 2/1978 Fed. Rep. of Germany .

1102392 10/1955 France .

1470209 1/1967 France .

490912 7/1970 Switzerland .

*Primary Examiner*—Kuang Y. Lin

*Attorney, Agent, or Firm*—Pollock, Vande Sande & Priddy

[57] ABSTRACT

According to the invention, molten metal 3 is poured into a continuous-casting ingot mold and the thickness of the product 1 emerging from the ingot mold is reduced using a device for reducing the thickness 20, while the core 5 of said product has still not solidified.

The thickness of the product 1 is reduced only in a central zone, excluding the solidified edges of the product, using means for reducing the thickness such as rolls 22 whose working length is less than the width of the large faces 11 of the ingot mold.

Means 8 are provided downstream of the rolls 22 in order to crop the edges 7' of the product in the manufacture of thin slabs 9.

9 Claims, 1 Drawing Sheet

FIG. 1
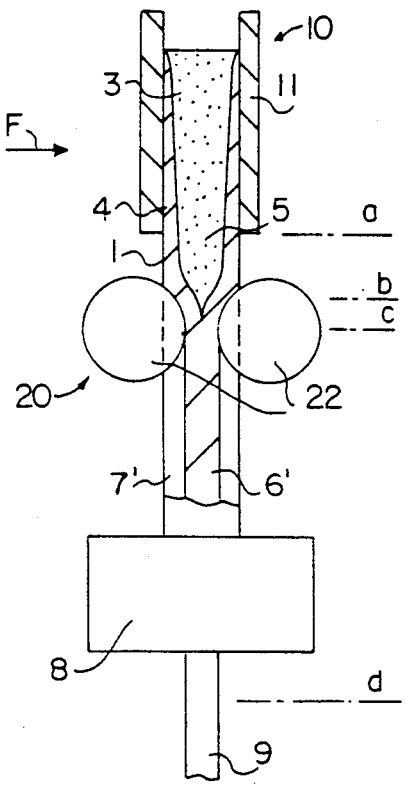
FIG. 2
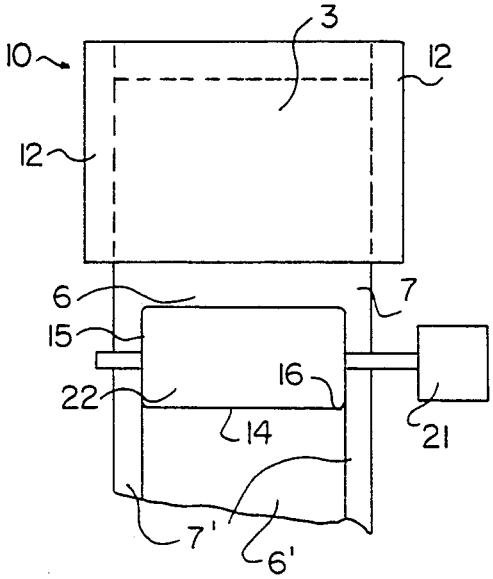
FIG. 3a
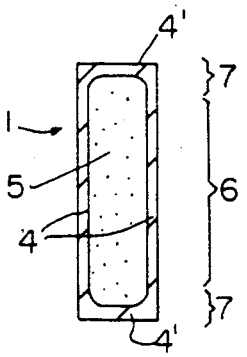
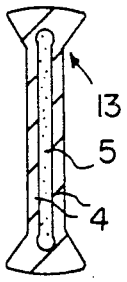
FIG. 3b
FIG. 3c
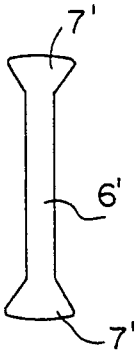
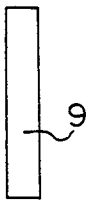
FIG. 3d

PROCESS AND INSTALLATION FOR CASTING THIN METAL PRODUCTS, WITH REDUCTION OF THICKNESS BELOW THE INGOT MOLD

FIELD OF THE INVENTION

The present invention relates to a process for casting thin metal products, particularly steel products, such as thin slabs, according to which the molten metal is poured into an ingot mold of elongated cross-section and the thickness of the product emerging from the ingot mold is reduced directly as the product emerges, while the core of said product has still not solidified.

It also relates to a casting installation which makes it possible to implement this process, comprising an ingot mold with cooled fixed walls and a device located directly downstream of the ingot mold which is intended to reduce the thickness of the product cast in order to bring it to the final thickness desired for the thin product, this device comprising two squeezing components for bringing closer together and joining the solidified walls of the product emerging from the ingot mold, generally consisting of rolls acting on said product in the manner of rolling rolls.

PRIOR ART

Such procedures and installations are already known in regard to the production of thin slabs, that is to say those whose width is generally greater than three times the thickness, the latter being less than approximately 120 mm.

For example, it has already been proposed to pour the molten metal into an ingot mold whose small faces have a width which is small compared with the width of the large faces In particular, in order to be able to cause the nozzle to penetrate between the large faces, the ingot mold has, at least in its upper part, a central flaring, the large faces then having, for example, a "cocked hat"-shaped cross-section In order to bring the cast product to a rectangular cross-section, either the width of the flaring is progressively reduced from the top of the ingot mold downwards, where the latter has a rectangular cross-section, or the cast product, immediately downstream of the ingot mold, passes between two rolls which bring the large faces of the product closer together in order to bring them parallel to one another.

It has also been proposed to cast in an ingot mold of substantially constant elongated rectangular cross-section, the nozzle then having an extremely flattened cross-section so that it is possible for it to be inserted between the walls of the ingot mold.

In every case, the thickness of the product emerging from the ingot mold is reduced immediately downstream of the latter, while the core has not yet solidified, in order to bring the cast product to the desired thickness.

However, these processes have a major drawback resulting from the rolling of the edges of the product emerging from the ingot mold In fact, as has been indicated above, rolling is performed when the core of the product is still molten. In fact, this is not actually rolling, but rather a squashing of the product emerging from the ingot mold in order to bring the solidified skins of the large faces-of the latter closer until they are in contact. The central part of the large faces thus undergoes no substantial elongation during this squashing. On the other hand, due to the solidification of the edges of the product in the ingot mold, these are actually rolled, which leads to a deformation and an elongation of the edges. This results, on the one hand, in it being possible for the thin slabs obtained using these processes to have defects of the "long edges" type, which are well-known to rolling-mill operators, and, on the other hand, the elongation of the edges can give rise, in the solidified skins of the large faces, to tensile stresses so great that perforations, can be caused by rupture of these skins.

Moreover, rolling of the edges requires a pressing force on the rolls for reducing thickness, which is much greater than the force needed to bring the solidified skins of the central parts of the large faces closer together, which leads to oversizing the "rolling" device.

SUMMARY OF THE INVENTION

The present invention aims to solve the problems set forth above and to permit the production of thin products, such as thin slabs, of good quality, while restricting the dimensions of and thus the space required for the manufacturing installation.

With these aims in view, the subject of the present invention is a process for casting thin metal products, particularly thin slabs, of the type according to which the molten metal is poured into a continuous-casting ingot mold of elongated cross-section, from which the partially solidified metal is withdrawn continuously and the thickness of the product emerging from the ingot mold is reduced using a device for reducing the thickness located directly downstream thereof, while the core of said product has still not solidified According to the invention, this process is defined in that the thickness is reduced solely in a central zone of the product emerging from the ingot mold, that is to say excluding the solidified edges of said product, to a value which is less than half the thickness of said edges and, after said reduction in thickness, the edges of the product which have not been subjected thereto are cropped.

The reduction in thickness is preferably conducted in a manner so as to obtain a totally solidified product immediately downstream of the device for reducing thickness.

By virtue of the present invention, the "long edges" defects referred to above are eliminated or, at least, considerably reduced. In fact, in the process according to the invention, there is no rolling of the solidified zones of the product Only a central zone of the product, whose width corresponds to the width of the molten or pasty pool, is subjected to the reduction in thickness. The solidified skins of the large faces of the product are, in fact, brought closer to one another without there being any elongation thereof, the non-solidified metal of the core being pushed back somewhat towards the ingot mold. The solidified skins of the small faces of the product are not rolled and thus do not undergo elongation either. The result of this is that all the zones of the product whose metal is solidified in the ingot mold conserve their length, which prevents the appearance of differential stresses in the final product and deformation thereof.

A further subject of the invention is an installation for casting thin metal products, comprising a continuous-casting ingot mold with an elongated cross-section and a device for reducing the thickness of the product emerging from the ingot mold disposed directly downstream of the latter.

According to the invention, the installation is defined in that the device for reducing the thickness comprises means for reducing the thickness having a working width which is less than the width of the large faces of the ingot mold at its lower end, and in that it comprises cutting means for cropping the edges of the product, located downstream of the means for reducing the thickness.

These means for reducing the thickness preferably comprise at least one pair of rolls whose working length is less than the width of the large faces of the ingot mold at its lower end.

The installation according to the invention makes it possible to produce a product which is practically free from skin stresses. Moreover, the rolls for reducing the thickness, their supports and any drive means thereof can be reduced in size, since the forces to which they are subjected during rolling on the molten core are much less than those which would be needed in order to actually roll the solidified edges of the product.

Other features and advantages will become apparent from the description which will be given by way of example of a process and of an installation according to the invention which are applied to the casting of thin slabs.

BRIEF DESCRIPTION OF THE DRAWINGS

Reference will be made to the appended drawings, in which:

FIG. 1 is a diagrammatic sectional view of an installation for continuously casting thin slabs according to the invention;

FIG. 2 is a partial view of the installation according to the arrow F in FIG. 1;

FIG. 3 is a representation of the evolution of the cross-section of the product during manufacture.

DESCRIPTION OF THE PREFERRED EMBODIMENT

The installation shown in FIGS. 1 and 2 comprises a continuous-casting ingot mold 1 with an elongated rectangular horizontal cross-section and a device 20 for reducing thickness comprising a pair of rolls 22 which are driven in rotation by drive means 21 and placed just below the ingot mold, the axes of the rolls being parallel to the large walls 11 of the ingot mold.

The large walls 11 and the small walls 12 of the ingot mold, as well as the rolls 22, are cooled in a conventional manner, for example by means of the internal circulation of a cooling fluid.

As may be seen in FIG. 2, the working length of the rolls 22, that is to say the length of their generatrix, is less than the width of the large walls of the ingot mold.

The molten metal 3 is poured into the ingot mold where it begins to solidify in contact with the cooled walls, forming solidified skins 4, 4'. On emerging from the ingot mold (level a), the cross-section of the product 1, shown in FIG. 3*a*, comprises a solidified peripheral zone formed by the skins 4, 4' and a non-solidified core 5.

At the level b, located above the plane of the axes of the rolls 22 and below their upper generatrices, the skins 4, solidified in contact with the large walls 11 of the ingot mold, are brought closer to one another in the central zone 6 of the product emerging from the ingot mold through the action of rolling of the rolls. On the other hand, the edges 7 of the product are not gripped by the rolls and therefore retain their thickness. The skins 4',, solidified in contact with the small walls 12 of the ingot mold, are not rolled and thus undergo no elongation. Similarly, the width of the product is not substantially increased. At the level b, the section of the product is as shown in FIG. 3*b*, having an elongated "dog bone" shape. The thickness of the non-solidified core 5 is progressively reduced as the product advances, due to the skins 4 coming closer together.

At the level c, corresponding to the plane of the axes of the rolls, the skins 4 are joined and form the web 6' of the product whose cross-section, shown in FIG. 3*c*, has an "I" shape, the flanges 7' of which have retained a width which is substantially equal to that of the small faces of the ingot mold, whereas the thickness of the central part of the product is substantially equal to half this width, that is to say of the width of the edges of the product emerging from the ingot mold. The reduction of the thickness of the central part can, of course be considerably greater, for example this thickness may be brought to only a fifth of the thickness of the edges.

As has been described above, the bottom of the solidification pool is preferably maintained at the level of the plane of the axes of the rolls 22, which ensures a good join between the two skins 4, this occurring in the pasty zone of the bottom of the pool. It is, however, possible to proceed in a manner such that the end of solidification occurs downstream of the rolls, particularly if the final desired thickness of the slab is sufficient However, in this case, it is necessary to ensure that the thickness of the solidified skins below the level of the axes of the rolls is sufficient to prevent the deformation thereof and a bulging of the product. Additional cooling may be particularly provided to this end in order to accelerate the solidification of the product.

In the illustrated case of the manufacture of thin slabs, the installation also comprises means 8 for cropping the flanges 7' of the solidified product obtained after passage between the rolls 22, such as shears or any suitable cutting means. The thin slab 9 obtained has a rectangular cross-section (FIG. 3*d*), whose thickness is equal to the spacing between the rolls and whose width is determined by the operation of cropping the flanges.

According to the preferred arrangement of the process and of the installation taken as an example, the rolls are driven in rotation by drive means 21. It is thus these rolls which form the means for withdrawing the product emerging from the ingot mold.

Withdrawal may also be performed by means of specific withdrawal means, such as withdrawal rollers, of the types currently used in continuous casting, located downstream of the device for reducing the thickness.

The withdrawal speed is thus determined by the withdrawal means and the speed of the rolls for reducing the thickness is controlled as a function of the speed of the withdrawal means.

The withdrawal means may also be independent of the device for reducing the thickness For example, the work rolls may be free in rotation, withdrawal being performed solely by the specific withdrawal means.

These latter arrangements have the advantage, in particular, of ensuring a regular progression of the product and preventing any skidding of the work rolls on the product, there being a risk of such skidding occurring particularly if the bottom of the solidification pool is located below the level of the axes of the rolls.

The edges of the rolls 22 will advantageously be shaped so as not to create substantial stresses in the skin of the product at the level of the join 13 between the central zone 6 and the edges 7. To this end, the edge of the rolls may, for example, be shaped as a round 16 joining the cylindrical surface 14 with the lateral faces 15 of the rolls. The radius of curvature of this round will be adjusted as a function of the desired reduction of the thickness and the nature of the metal cast.

The invention is not limited to the use of an ingot mold with a constant rectangular cross-section. The ingot mold may, for example, have concave large walls, the product emerging therefrom then having a thickness at its centre which is greater than that at the edges.

It may also have a rectangular cross-section only on emerging from the ingot mold at its lower end.

We claim:

1. Process for continuously casting thin metal products, of the type according to which molten metal is poured into a continuous casting ingot mold of elongated cross-section, from which the partially solidified metal is withdrawn continuously and the thickness of the product emerging from the ingot mold is reduced using a device for reducing the thickness located directly downstream thereof, while the core of said product has still not solidified, said process comprising the steps of (a) reducing the thickness of said product solely in a central zone of said product emerging from said ingot mold, excluding solidified edges of said product, to a value which is less than half the thickness of said edges; and (b) after said reduction in thickness, cropping said edges of said product.

2. The process as claimed in claim 1, wherein said cross-section on emerging from said ingot mold is substantially rectangular.

3. The process as claimed in claim 1, wherein said reduction in thickness is conducted in such a manner as to produce a totally solidified product immediately downstream of said device for reducing thickness.

4. The process as claimed in claim 1, wherein the device for reducing thickness comprises rolls driven in rotation.

5. The process as claimed in claim 4, including the step of withdrawing said product by means of said thickness reducing rolls.

6. Apparatus for casting thin metal products, comprising a continuous-casting ingot mold (1) with an elongated cross-section and a device for reducing a thickness of a product emerging from said ingot mold, said device being disposed directly downstream of said ingot mold, wherein the device for reducing said thickness comprises means for reducing the thickness having a working width which is less than a width of large faces of said ingot mold at a lower end of said ingot mold, and wherein it comprises cutting means (8) for cropping edges of said product, located downstream of said means for reducing said thickness.

7. Apparatus as claimed in claim 6, wherein said means for reducing said thickness comprise at least one pair of rolls (22) having a working length less than said width of said large faces of said ingot mold at said lower end.

8. Apparatus as claimed in claim 6, wherein said ingot mold has a substantially rectangular exit section.

9. Apparatus as claimed in claim 7, wherein edges of a cylindrical surface (14) of said rolls (22) are connected to lateral faces (15) of said rolls by means of a round.

* * * * *